United States Patent [19]

Schmidt

[11] Patent Number: 4,723,789

[45] Date of Patent: Feb. 9, 1988

[54] SECTIONED SKI

[76] Inventor: Glenn H. Schmidt, 1857 Los Encinos, Glendale, Calif. 91208

[21] Appl. No.: 855,822

[22] Filed: Apr. 24, 1986

Related U.S. Application Data

[63] Continuation-in-part of Ser. No. 292,787, Aug. 14, 1981, abandoned, and a continuation-in-part of Ser. No. 544,537, Oct. 24, 1983, Pat. No. 4,600,211.

[51] Int. Cl.[4] ..... A63C 5/02

[52] U.S. Cl. ..... 280/603; 156/268

[58] Field of Search ..... 156/268; 280/601, 603

[56] References Cited

U.S. PATENT DOCUMENTS

| | | | |
|---|---|---|---|
| 526,216 | 9/1894 | Bremen | 280/603 |
| 2,375,504 | 5/1945 | Svensson | 280/603 |
| 2,450,538 | 10/1948 | Beaudin | 280/603 |
| 3,104,888 | 9/1963 | Day et al. | 280/603 |
| 3,797,838 | 3/1974 | Shungot et al. | 280/603 |
| 3,825,360 | 7/1974 | Galich | 280/603 X |
| 4,155,568 | 5/1979 | Galich | 280/603 |

*Primary Examiner*—Nancy A. B. Swisher

*Attorney, Agent, or Firm*—William W. Haefliger

[57] ABSTRACT

A ski includes at least two sections interconnectible end-to-end, one section having a recess sunk in an end portion thereof and the other ski section having a tongue projecting from an end portion thereof, the recess and tongue shaped to closely interfit when the ski sections are assembled, end-to-end, thereby to provide a full length ski, there being structure to positively and releasably interconnect said end portions in assembled condition. A method of forming the ski assures tight interfit of the recess and tongue; and the tongue cannot be inadvertently pulled from the recess.

25 Claims, 27 Drawing Figures

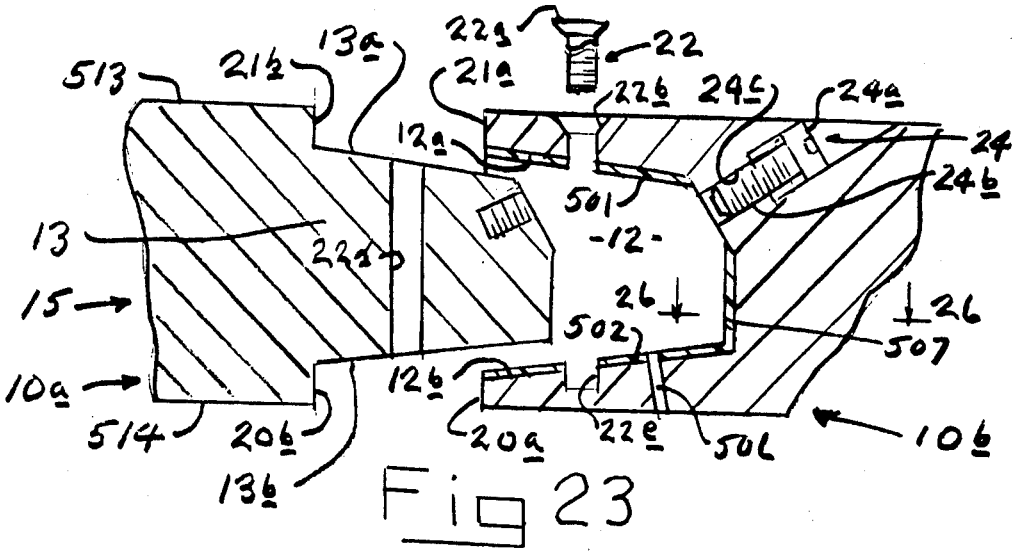
Fig 23
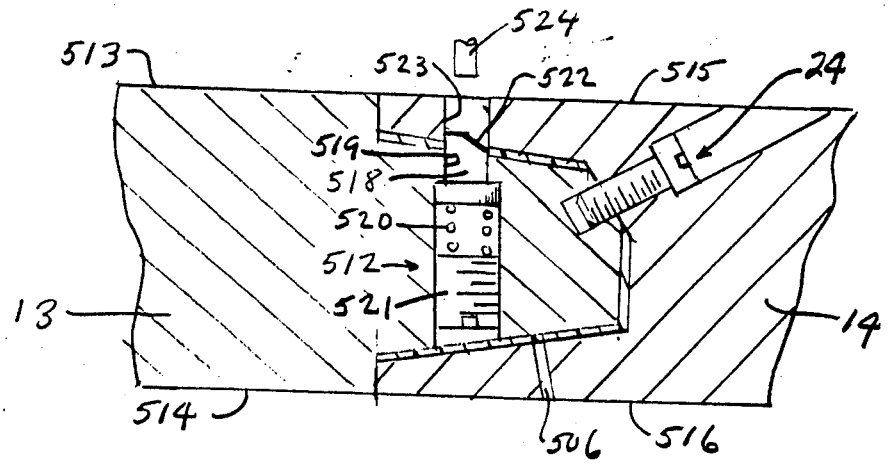
Fig 24
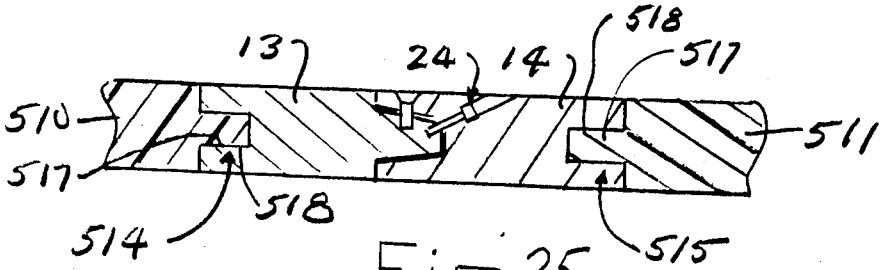
Fig 25
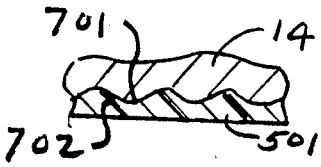
Fig 27
Fig 26
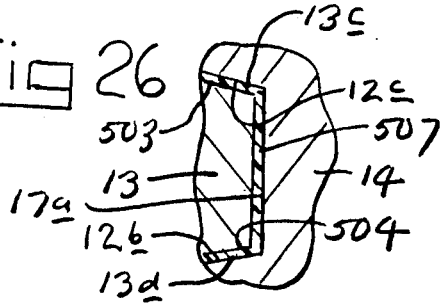

SECTIONED SKI

This application is a continuation-in-part of Ser. No. 292,787, filed Aug. 14, 1981, U.S. Pat. No. 4,600,211 6-12-85 now abandoned and of Ser. No. 544,537, filed Oct. 24, 1983.

BACKGROUND OF THE INVENTION

This invention relates generally to ski equipment, and more particularly to a ski and pole constructions capable of being quickly broken into sections for ease of transport, the sections being readily re-assembled for use.

It is a known fact that skis and poles are cumbersome to carry or transport, either by hand or on vehicles. Accordingly, there has long been a need to overcome the cumbersome problem. While various ways of providing interconnectable ski sections have been proposed, as in U.S. Pat. Nos. 382,254; 2,198,361; 3,104,888; 3,439,928 and 3,883,315, none to my knowledge embodies the unusually advantageous simplicity of structure, and ease of disassembly and re-assembly as well as other features as now embodied in the present ski construction. Also, none suggests the unobvious method of assuring positive interfit, and blocking of separation, as are now disclosed.

SUMMARY OF THE INVENTION

It is a major object of the invention to provide an improved ski construction overcoming prior problems and meeting the above need. Basically, the ski comprises:

(a) at least two ski sections interconnectible end-to-end, (b) one ski section having a recess sunk in an end portion thereof and the other ski section having a tongue projecting from an end portion thereof, the recess and tongue having conforming complementary wedge shapes to closely interfit when the ski sections are assembled, end-to-end, thereby to provide a full length ski, the tongue received into the recess, and the tongue having four end tapers in generally horizontal and vertical planes to be completely surrounded by complementary tapers of said recess, (c) and threaded fastener means to positively and releasably interconnect said end portions in assembled condition, said fastener means everywhere confined within space between planes defined by outer top, bottom and opposite side major flat surfaces of one or both of said sections in interfitted condition, and the fastener means passing through planes defined by at least two complementary recess and tongue tapered wedge surfaces, said fastener means including, in one form, two threaded fasteners spaced apart generally lengthwise of the ski, use of but one fastener also being contemplated, (d) there being four interengaged pairs of stop shoulders on the ski sections to resist up and down and lateral bending, the shoulders located proximate the root ends of the four tapers on the tongue, all of said stop shoulders also everywhere confined within spaced between said planes defined by said section major flat outer surfaces, said stop shoulders intersecting said surfaces, (e) said recess and tongue complementary wedge shapes including (i) polished surfaces defined by the tongue, (ii) plastic filler surfaces defined by the recess, (iii) the plastic filler surfaces having been deformed by the polished surfaces of the tongue preliminarily received fully into the recess, and the plastic filler surfaces then having been allowed to cure, so as to be in cured state when the tongue is received to closely interfit the recess as defined in (b).

As will appear, the tongue and recess (or groove) have wedge interfit, as for example in directions endwise, lateral to, or perpendicular to the ski top surface length dimension; and interengageable stop shoulders are provided on the sections to strengthen the assembled ski as against bending during use. Further, the interconnection means typically comprise a fastener, or fasteners, that extend between the sections near the tongue and recess (and typically intersect same), the fastener characterized as easily removable and re-insertible. In addition, the ski binding plate may overlap the joint between the sections to assist in positive fastening.

Another object is the provision of sections having metal-to-metal interfit at said interengaged pairs of stop shoulders to positively limit pressural engagement of said polished surfaces of the tongue with said filler surfaces. As will appear, vent means is provided in at least one section to pass air trapped in said recess upon reception of the tongue therein prior to curing of the plastic filler.

A further object is the provision for each ski section to have a metallic portion and a non-metallic portion, said metallic portions defining said tongue and recess, said non-metallic portions interlocked to said metallic portions at locations spaced lengthwise of the ski from said tongue and recess. In this regard, the metallic portion and non-metallic portion of each ski section have tongue and groove interfit at an interlock location.

A further object includes the provision of a spring-urged latch interconnecting said metallic portions and at the tongue and recess interfit location, and within the confines of the ski section outer surfaces.

The method of the invention includes the steps, in the structure of (a)–(d) above, of:

(e) providing said tongue with polished surfaces, (f) providing the recess with initially uncured plastic filler surfaces, (g) initially inserting the tongue into the recess to engage the plastic filler surfaces to cause the tongue to deform the plastic surfaces to final shape exactly conforming to fully inserted tongue surface shape, (h) removing the tongue from the recess and allowing said plastic surfaces to cure, (i) and subsequently re-inserting the tongue into the recess to engage the cured plastic surfaces, and tightening said fastener means.

As will appear, a film of release agent may be provided between the tongue and said uncured plastic filler during said (g) step; and also allowing the plastic filler to bond to the ski section defining the recess, as it cures.

Accordingly, conformation of the filler to the polished tongue is assured, as well as release of the tongue from the conformed filler to allow it to cure.

These and other objects and advantages of the invention, as well as the details of an illustrative embodiment, will be more fully understood from the following specification and drawings, in which:

DRAWING DESCRIPTION

FIG. 1 is a section taken on lines 5—5 of FIG. 2;

FIG. 8 is another view like FIG. 4;

FIGS. 23, 24 and 25 are elevations, in section, showing modifications, and FIG. 26 is a fragmentary section on lines 26—26 of FIG. 23.

FIG. 27 is a fragmentary section.

DETAILED DESCRIPTION

Referring first to FIGS. 1, 2 and 4-6, a ski 10 includes two sections 10*a* and 10*b*, the joint therebetween indicated generally at 11. That joint is typically located at about the mid position, endwise, of the ski, so that each of the sections is about ½ the ski overall length. This greatly facilitates carriage or transport of the two sections in side-by-side relation, for example.

One ski section has a recess sunk in and end portion of same, and the other ski section has a tongue projecting from an end portion thereof. The recess and tongue are shaped to closely interfit when the sections are assembled, end-to-end, to provide the full length ski of bending strength substantially equivalent to the bending strength of the same ski with unbroken construction.

Figure 3:
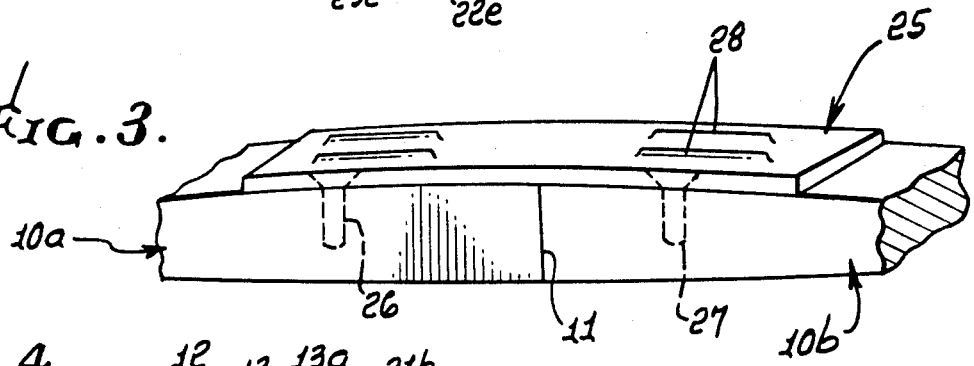
FIG. 3 is a perspective view of a ski joint as in FIGS. 1 and 2, with a binding plate removably interconnecting the two sections.
Figure 4:
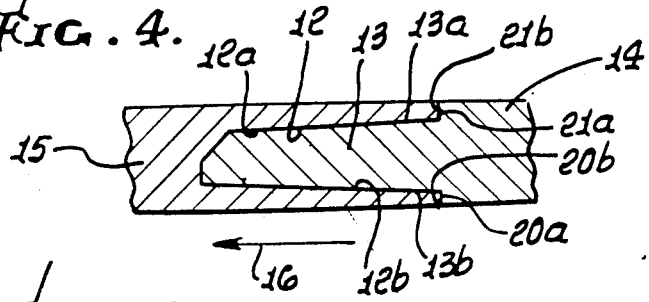
FIG. 4 is a section taken on lines 4—4 of FIG. 1.
Figure 5:
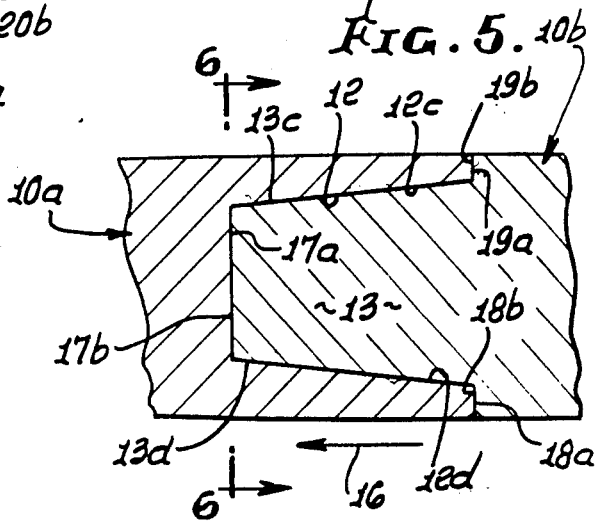
Figure 6:
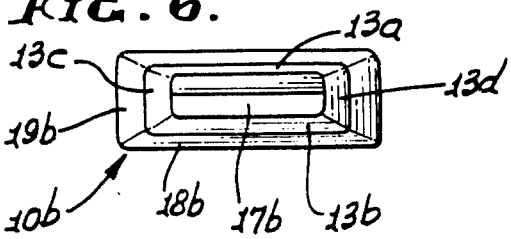
FIG. 6 is a section taken on lines 6—6 of FIG. 5.

In the example, the recess and tongue are indicated at 12 and 13 as respectively associated with ski end portions 14 and 15, in FIGS. 4 and 5. The illustrated recess has upper and lower interior walls 12*a* and 12*b* which taper in the interfit direction indicated by arrow 16; and the tongue has upper and lower exterior walls 13*a* and 13*b* which taper in direction 16 to engage with 12*a* and 12*b* on make-up. Also, the recess has opposite side walls 12*c* and 12*d* which taper in direction 16, and the tongue likewise has opposite side walls 13*c* and 13*d* which taper in direction 16 to engage recess walls 12*c* and 12*d* upon make-up. Interengageable stop shoulders to limit make-up are indicated at 17*a* and 17*b*, 18*a* and 18*b*, 19*a* and 19*b*, 20*a* and 20*b*, and 21*a* and 21*b*, in FIGS. 4-6. Shoulders at its base. Also, shoulders 18*a*-21*a* define the junction line 11, seen in FIGS. 1-3. Interengaged shoulders 20*a* and 20*b* and 21*a* and 21*b* aid in resisting relative up and down bending of the ski sections, at joint 11, the interengaged tongue and recess walls also resisting such relative bending.

Figure 1:
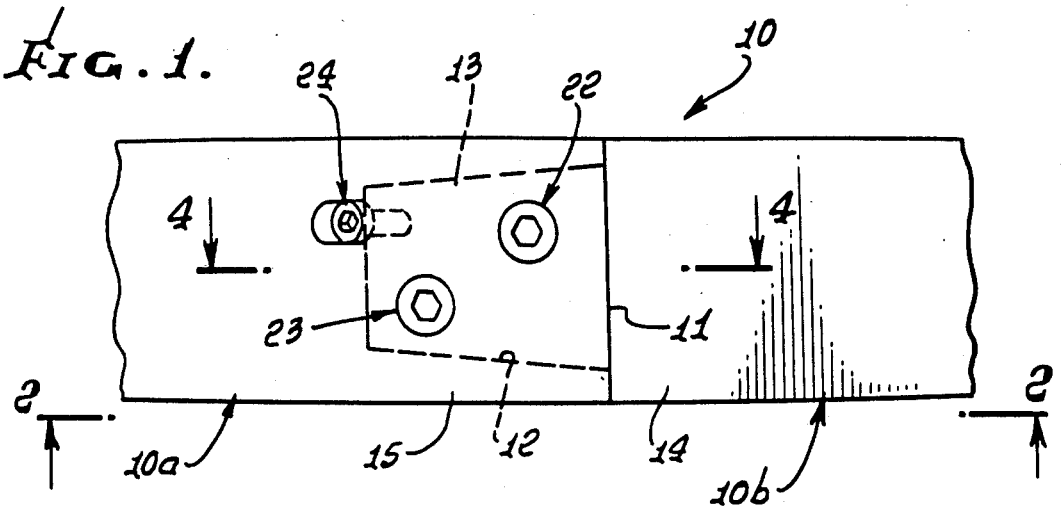
FIG. 1 is a plan view of a ski section joint embodying the invention.
Figure 2:
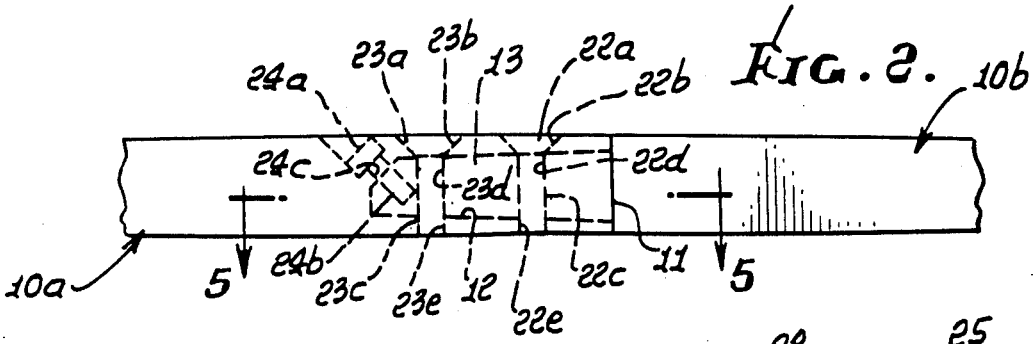
FIG. 2 is a side view taken on lines 2—2 of the FIG. 1.

Also provided is means to positively and releasably interconnect the ski sections at the locus of the tongue and recess. As illustrated, three fasteners are provided at 22-24. Fasteners 22 and 23 have tapered heads 22*a* and 23*a* received against tapered seats 22*b* and 23*b* in the portion of ski section 10*a*; also the fastener shanks 22*c* and 23*c* pass downwardly through openings 22*d* and 23*d* in the tongue, and then have threaded interfit with the lower portion of the ski section 10*a*, at loci 22*e* and 23*e*, all of which is seen in FIG. 2. Such fasteners may have hex-openings as shown in their heads, to facilitate quick insertion and tightening of the fasteners, as well as removal, by the skier. Fastener 24 extends obliquely downwardly and endwise (relative to the ski sections), and has a head 24*a* on an internal shoulder in the section 10*a*, and a threaded shank 24*b*, into a threaded bore 24*c* in the end of tongue 14.

In FIG. 3, a ski binding plate 25 is shown as overlapping the two sections 10*a* and 10*b*, i.e. across joint 11, and as removably connected thereto, as via fasteners 26 and 27. The latter have heads that seat in tapered openings in the plate, and shanks that pass downwardly into threaded openings in the ski sections, endwise beyond the tongue and groove loci. On the top of plate 25 are ridges 28 that interengage similar ridges on a skier's boot.

Figure 7:
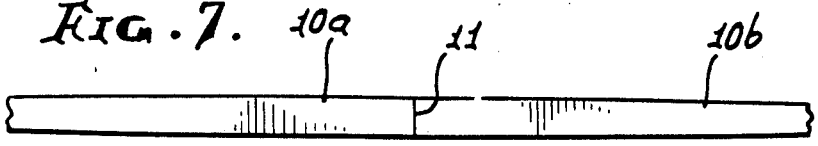
FIG. 7 is a side view of a portion of an all metal ski embodying the invention of FIGS. 1-6, and showing the external appearance of the joint between the ski sections.
Figure 8:
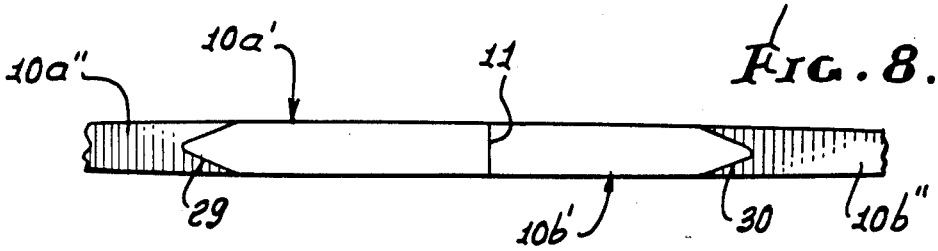
FIG. 8 is a view like FIG. 7, but showing ski sections each consisting of metal connected with molded glass fiber portions.

FIG. 7 shows a greater length of ski 10, and in all-metal form. In FIG. 8, the ski sections 10*a* and 10*b* are constructed of metal portions 10*a*′ and 10*b*′, and molded glass-fiber portions 10*a*″ and 10*b*″. Portions 10*a*′ and 10*a*″ are integrally interconnected at endwise V-tapered joint 29, as shown; and portions 10*b*′ and 10*b*″ are likewise integrally interconnected at endwise V-tapered joint 30.

Figure 9:
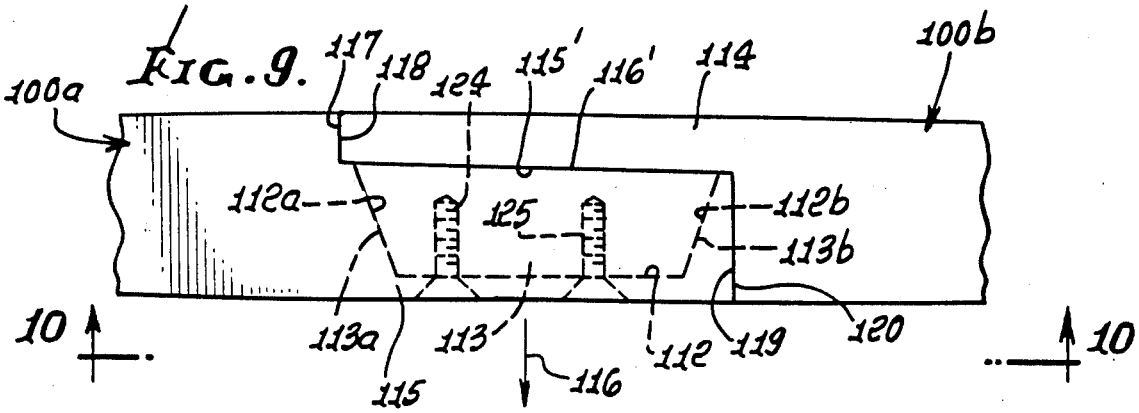
FIG. 9 is a plan view like FIG. 1 showing an alternate construction.

Referring now to FIG. 9, the ski sections 100*a* and 100*b* correspond in general to sections 10*a* and 10*b* above. Tongue 113 integral with end portion 114 of section 100*b* wedgably interfits recess 112 formed in the end portion 115 of section 100*a*. The interfit is lateral of the ski lengthwise dimension, i.e. direction indicated by arrow 116. Note the tongue end wall taper at 113*a* and 113*b*, and corresponding recess end wall taper at 112*a* and 112*b*. Tapers 112*a* and 113*a* interengage on make-up, as do tapers 112*b* and 113*b*. Longitudinal stop shoulders 115′ and 116′ on the portions 114 and 115 interengage on lateral make-up, and lateral stop shoulders 117 and 118, and 110 and 120 also interengage on make-up. Interconnection fasteners 124 and 125 extend laterally, as shown, to releasably interconnect the sections at the tongue and recess locus.

Figure 10:
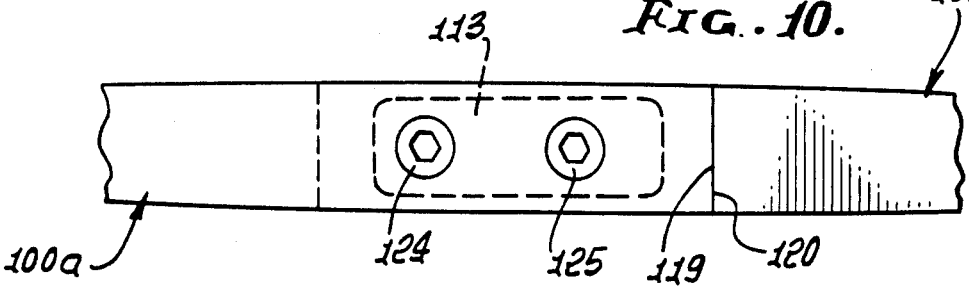
FIG. 10 is a side view , in elevation, taken on lines 10—10 of FIG. 9.
Figure 11:
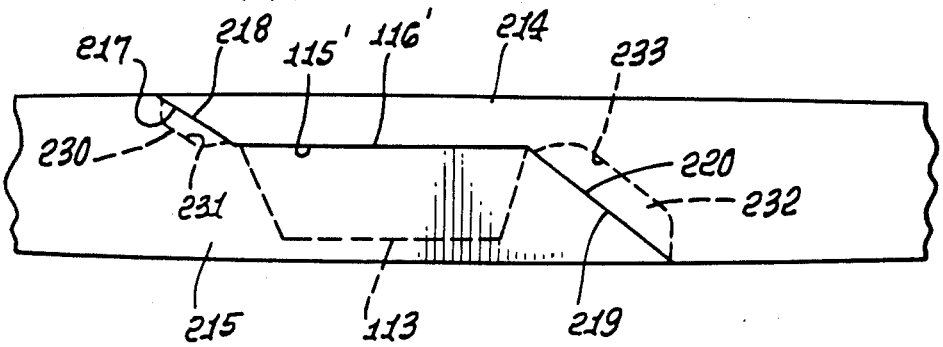
FIG. 11 is a top plan view like FIG. 7, but showing another alternative construction.

In FIG. 11, the construction is like that in FIGS. 9 and 10, except that stop shoulders 217 and 218 (corresponding to 117 and 118 in FIG. 9) and stop shoulders 219 and 220 (corresponding to 119 and 220) are angled or beveled, as shown. Also, a smaller tongue 230 on section 214 interfits a recess 231 on section 215, adjacent shoulders 217 and 218; and, a smaller tongue 232 on section 215 interfits a recess 233 on section 214, adjacent shoulders 219 and 220.

Figure 12:
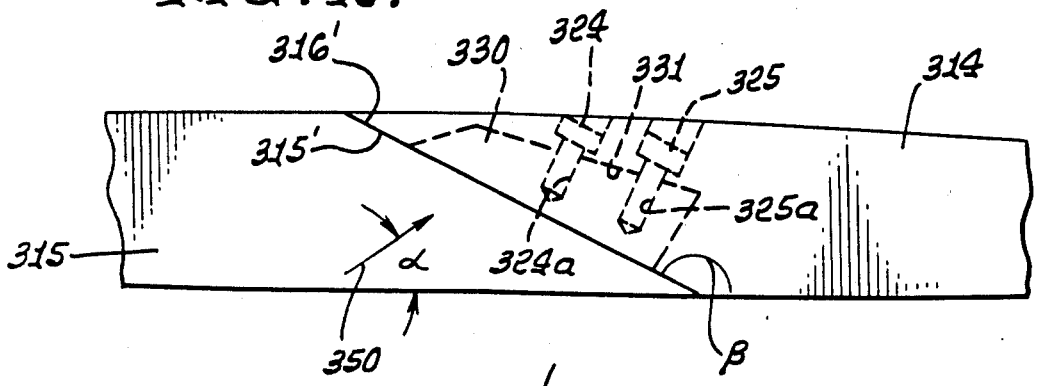
FIG. 12 is a top plan view like FIG. 7, but showing a further and alternative construction.

In FIG. 12, the construction is again similar to that of FIGS. 9 and 10, except that the tongue 330 on section 315 extends in direction 350 into the recess 331 in section 314 with wedging interfit. Direction 350, indicated by an arrow, is at an angle $\alpha$ relative to the ski lengthwise direction. Angle $\alpha$ is less than 90° and is between about 25° and 65°. Fasteners 324 and 325 extend from recesses in section 314 into threaded openings 324*a* and 325*a* in the tongue. Stop shoulders 315' and 316' on the sections define a plane which extends at an angle $\beta$ relative to the ski lengthwise direction. Angle $\beta$ is between 90° and 180° and is typically between about 135° and 160°.

Figure 13:
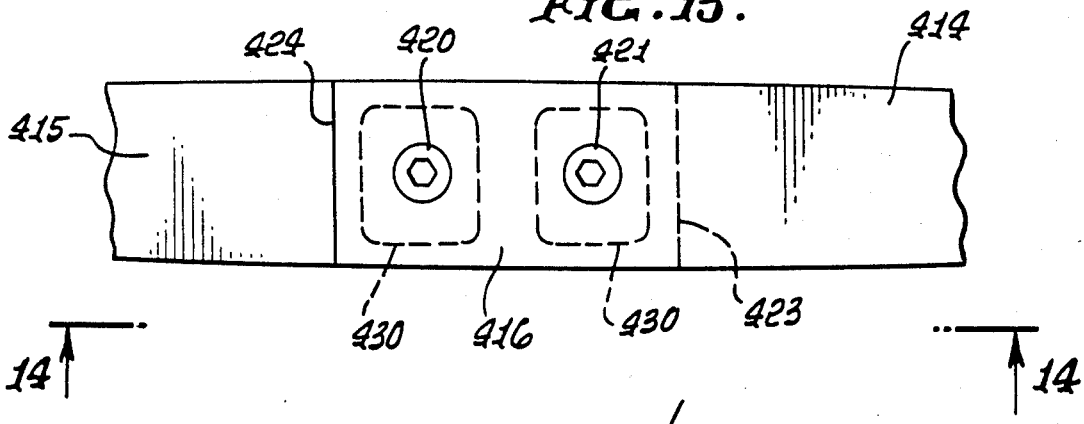
FIG. 13 is a top plan view of a further modified ski construction.
Figure 14:
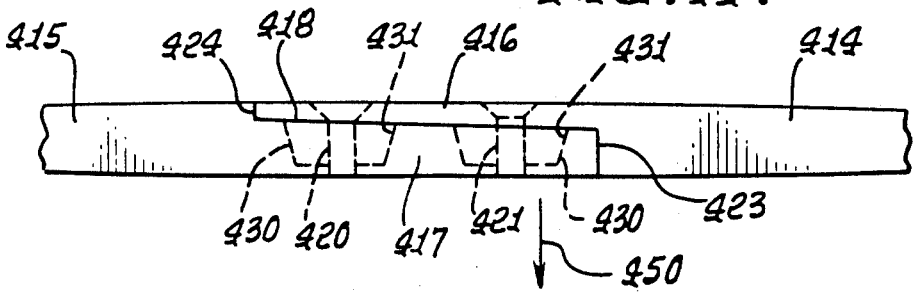
FIG. 14 is a side view taken on lines 14—14 of FIG. 13.

In FIGS. 13 and 14 the two tongues 430 on section 414 extend in direction 450 into recesses 431 in section 415, with wedging interfit. Direction 450 indicated by the arrow is perpendicular to the flat plane of the ski top surface. Ski portions 416 and 417 have overlapping-underlapping relationship as shown, and define an interengagement plane 418. Fasteners 420 and 421 have heads received in portion 416 to positively interconnect the sections. Stop shoulders appear at the ends of portions 416 and 417, a locations 423 and 424.

Figure 15:
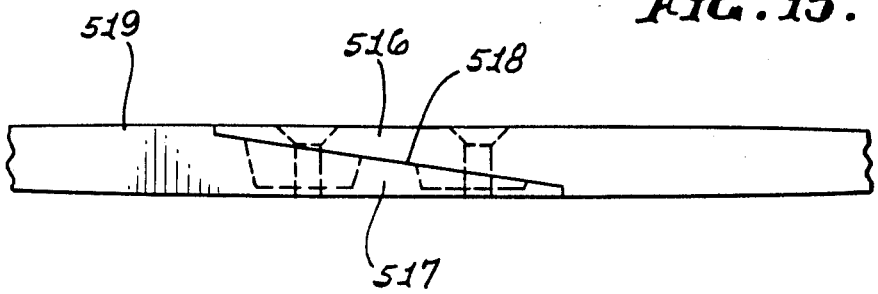
FIG. 15 is a side view like FIG. 14, but showing a modification.

In FIG. 15 the construction is again like that in FIGS. 13 and 14, except that the ski portions 516 and 517 that have overlapping-underlapping relationship define an interengagement plane 518 that is tilted relative to the plane of the ski top surface 519.

Figure 16:
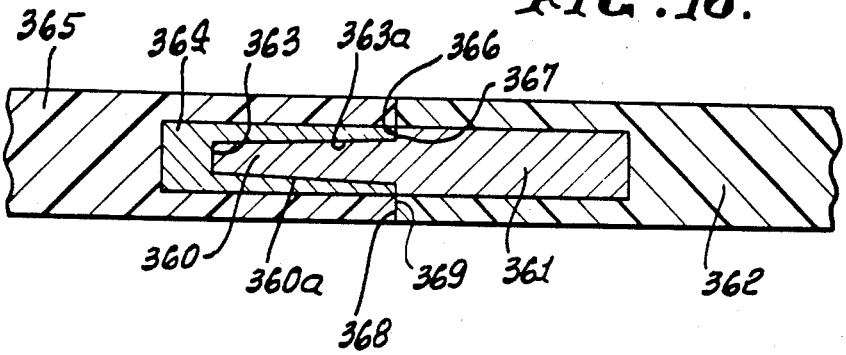
FIG. 16 is a view like FIG. 8, showing a somewhat different fabrication technique.

In FIG. 16, the endwise tapered tongue 360 integral with end portion 361 of ski section 362 wedgably interfits endwise tapered recess 363 formed in the end portion 364 of ski section 365. The tapers 360*a* and 363*a* interengage on make-up, as do abutting stop shoulders 366 and 367. Also, stop shoulders 368 and 369 on the surrounding glass fiber ski sections interengaged on make-up, and align with shoulders 366 and 367 to form a single joint. Portions 361 and 364 are metallic inserts in the surrounding glass fiber body material.

Figure 17:
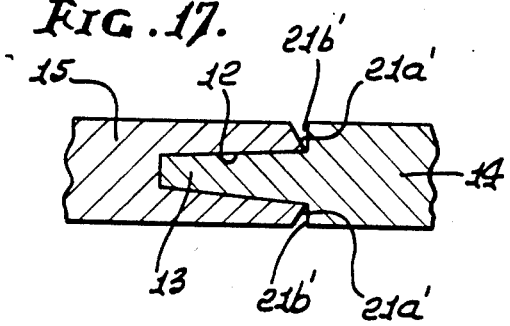
FIG. 17 is a view like FIG. 4.

FIG. 17 is a view like FIG. 4, and bears the same numbers except for end shoulders 21*a'* and 21*b'* (corresponding to shoulders 21*a* and 21*b* in FIG. 2). Shoulders 21*a'* and 21*b'* diverge in directions away from the tongue 13, to provide relief, permitting greater joint, bending flexibility, vertically. The angle of divergence (relief angle) may be less than about 5° to permit ultimate interengagement of the shoulders to limit bending.

Figure 18:
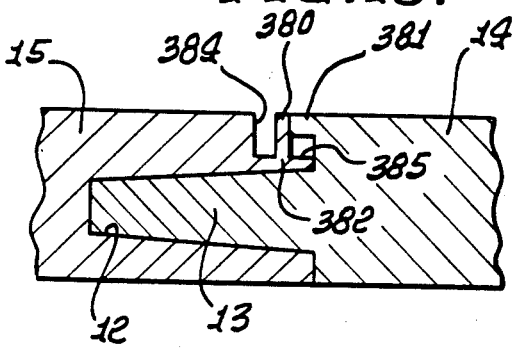

FIG. 18 is again like FIG. 4, and also FIG. 17, except that a bending flange 380 integral with ski end portion 15 resiliently resists upward deflection of end portion 14. A horizontally projection 381 on section 14 engages vertical flange 380, as shown, above its juncture 382 with section 15, to forcibly urge it to the left, as section 14 flexes upwardly. Note notches 384 and 385 in end portion 15, and opposite sides of flanges 380.

Figure 19:
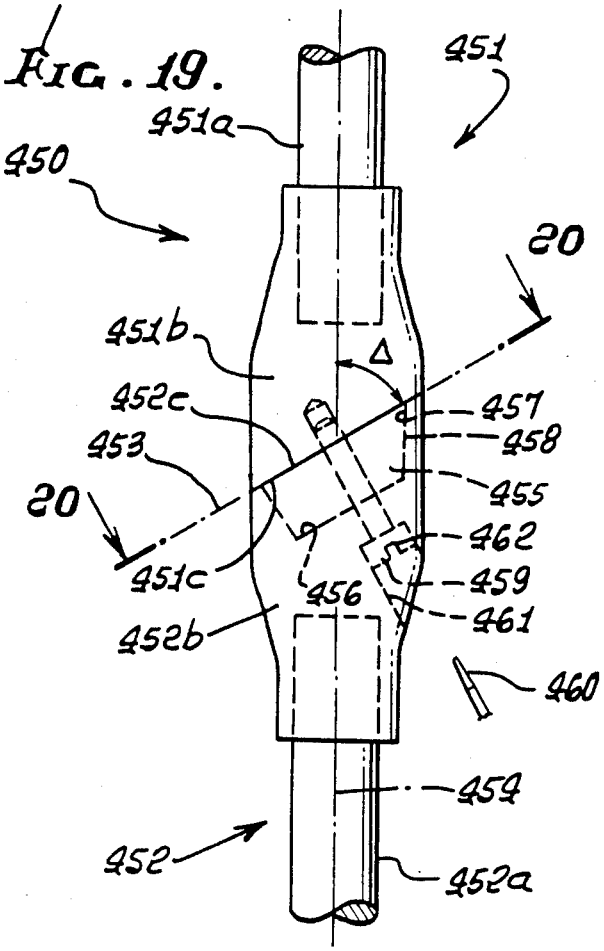
FIG. 19 is an elevation showing a ski pole joint embodying the invention.
Figure 20:
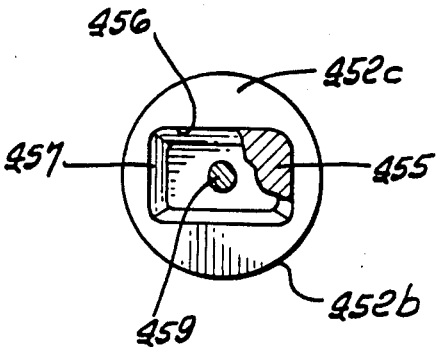
FIG. 20 is a section on lines 20—20 of FIG. 19.

Referring to FIGS. 19 and 20, a ski pole 450 includes sections 451 and 452. Sections 451 includes rod 451*a* and end portion 451*b*; and section 452 includes rod 452*a* and end portion 452*b*. End portions 451*b* and 452*b* have opposed terminals 451*c* and 452*c* which are typically engaged when the end portions are assembled together. They define a plane 453 which extends non-perpendicularly, i.e. at angle $\Delta$, with respect to the axis 454 defined by the section. That angle is typically between 30° and 60°.

End portion 451*b* defines a tongue 455 projecting into and interfitting a recess 456 defined by end portion 452*b*. The tongue and recess have interfitting tapers, as for example are represented at locations 457 and 458, as in the case of the ski section described above. A removable fastener means, such as threaded fastener 459, projects as shown through the tongue and groove, and between end portions 452*b* and 451*b*, to hold the latter together. When it is desired to disassemble the pole sections for transport, fastener 459 is removed, as by inserting a screw driver tip 460 into the side recess 461 in end portion 452*b*, and into the groove 462 in the fastener head, to rotatably back the fastener out of retaining position. FIG. 20 shows the tongue and recess 456 as typically having generally rectangular cross sections.

Figure 21:
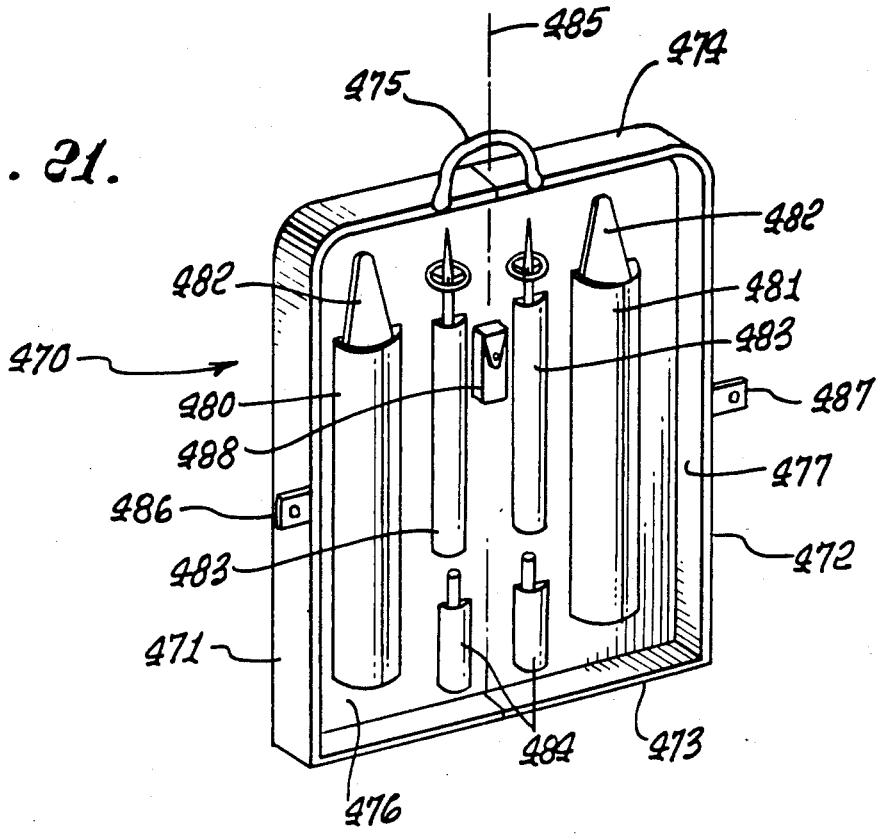
FIG. 21 is an elevation showing a carrying case for the sectioned ski.

Referring to FIG. 21, a ski equipment carrier in the form of a case 470 has side, bottom and top walls 471–474, and a handle 475 for transport. Interior wall 476 is spaced inwardly to form a recess 477 in the case adapted to receive ski equipment. Pockets 480 and 481 on wall 476 have open upper ends to receive disconnected ski sections 482 as referred above. Pockets 483 receive disconnected pole upper sections, and pockets 484 receive pole lower sections. A parts compartment is shown at 488. The case may be closed, as by folding about axis 485, for transport or storage. Retainers 486 and 487 are interconnected to hold the case closed.

Figure 22:
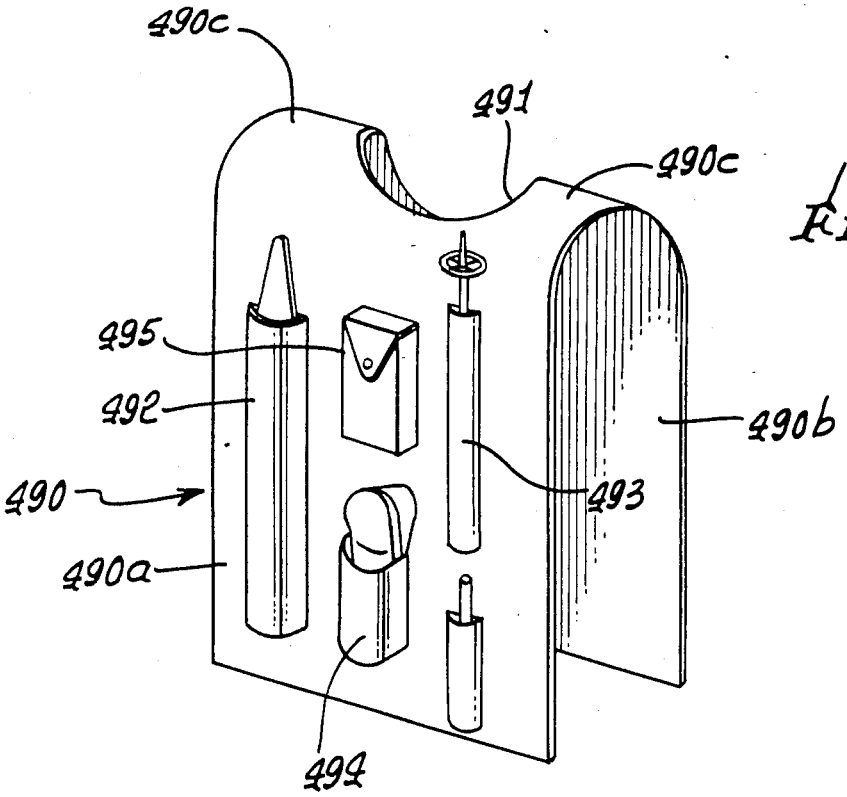
FIG. 22 is an elevation showing a modified carrier for the sectioned ski.

In FIG. 22, the modified carrier 490 forms a pack to be carried by the skier's body, as with front and back panels 490*a* and 490*b*. A neck or head hole 491 passes over the head of the skier, so that pack shoulder portions 490*c* are carried by the skier's shoulder. Thus, the carrier has inverted U-shape. Pockets for ski sections, pole sections and shoes appear at 492–494, on each of the panels, for equally distributing weight. A utility pocket appears at 495.

In FIG. 23, the elements are generally the same as in FIGS. 1–7, and corresponding elements bear the same numerals, as at 10*a* and 10*b*. The recess and tongue are again indicated at 12 and 13, as respectively associated with ski end portions 14 and 15. All of the tapers, four on the tongue and four on the recess, are again provided, as are the four pairs of stop shoulders, and described in FIGS. 4–6, for example. Fastener 22 is the same as before, as are elements 22*a*–22*e*.

Accordingly, the structure includes:

(a) at least two ski sections interconnectible end to end, (b) one ski section having a recess sunk in an end portion thereof and the other ski section having a tongue projecting from an end portion thereof, the recess and tongue having conforming complementary wedge shapes to closely interfit when the ski sections are assembled, end to end, thereby to provide a full length ski, the tongue received into the recess, and the tongue having four end tapers in generally horizontal and vertical planes to be completely surrounded by complementary tapers of said recess, (c) and threaded fastener means to positively and releasably interconnect said end portions in assembled condition, said fastener means everywhere confined within space between planes defined by outer top, bottom and opposite side major flat surfaces of one or both of said sections in interfitted condition, and the fastener means passing through planes defined by at least two complementary recess and tongue tapered wedge surfaces, said fastener means including, in one form, two threaded fasteners spaced apart generally lengthwise of the ski, use of but one fastener being contemplated, (d) there being four interengaged pairs of stop shoulders on the ski sections to resist up and down and lateral bending, the shoulders located proximate the root ends of the four tapers on the tongue, all of said stop shoulders also everywhere confined within space between the planes defined by said section major flat outer surfaces, said stop shoulders intersecting said surfaces.

The recess and tongue complementary wedge shapes may also include:

(i) polished surfaces defined by the tongue, on all four tapers 13*a*–13*d;*

(ii) plastic filler surfaces (as at 501–504 defined by recess 12);

(iii) the plastic filler surfaces having been deformed by the polsihed surfaces of the tongue preliminarily received fully into the recess, and the plastic filler surfaces then having been allowed to cure, so as to be in cured state when the tongue is received to closely interfit the recess as defined in (b).

It will be noted in FIG. 23 that filler material or layers are provided at 501–504 on all four recess tapers, prior to initial reception of the tongue into the recess, the filler being uncured, typically plastic, and capable of curing to hardened state and to bond to the surfaces 12*a*–12*d* of section 14. Sections 13 and 13 are both metallic, for high strength, (aluminum, for example); and the filler may consist of a urethane synthetic resin such as TC 745, a product of B&B Company, Huntington Beach, Calif. A release agent, such as carnuba wax is initially appled to the tongue surfaces 13*a*–13*d,* so that upon full receoption of the tongue into the recess, it will freely release from the filler upon tongue withdrawal. As the tongue is inserted into the recess, it displaces the plastic filler surfaces (uncured) to final shape, conforming exactly to the tongue polished surfaces. Air vents 506 release trapped air from the recess during such molding. The fastener 24 is then tightened (but not to complete tightness) to draw the tongue into final position, at which time the stop shoulders engage (shoulders 20*a* and 20*b,* and shoulders 21*a* and 21*b,* for example). Thin filler layers 501–405 then fill the gaps between the corresponding metal wall tapers of the tongue and recess; also, filler layer 507 fills the gap between the end of the tongue and the innermost wall of the recess, as shown.

After removal of the tongue, the thus precisely shaped filler layers are allowed to cure, and to bond to the metal walls of the recess. Subsequently, when the tongue is inserted and the joint fully tightened, by screw-in of fasteners 22 and 24, the tongue exactly and precisely fits the recess surfaces now defined by the cured and hardened filler layer, to provide an extremely tight and high strength joint.

FIG. 25 shows metal portions 13 and 14 connected to ski non-metallic (for example molded plastic) portions 510 and 511, which extend to the opposite ends of the full ski. Portions 510 and 13 are interlocked as at 514, and portions 511 and 14 are interlocked at 515. Each interlock is a tongue and groove interfit, as at 516 and 517, there being no taper. Suitable bonding agent, such as epoxy at 518, bonds the elements, at the interlock locations. Thus, the benefit of extreme strength at the junction of the ski sections, and flexibility of portions 510 and 511 are realized.

FIG. 24 shows the provision of a spring-urged latch mechanism 512 interconnecting the metallic portions 13 and 14, and at the tongue and recess locations, within the confines of the ski section outer surfaces 513 and 514, and 515 and 516. The mechanism includes a latching element 518 carried by one of the sections, i.e. in an opening at 519, and initially projecting into the recess 12. As the tongue is inserted, the latch.element is cam-deflected inwardly to further compress spring 520 held in position by a retainer 521. See cam surface 522 on the latch element. When the tongue is fully inserted, the latch forward end snaps into a recess 523 formed in part 14 to retain it in place against inadvertent withdrawal or separation. A means, such as a pin 524 is manually insertible in opening 523 to engage the latch element and cam it inwardly, releasing the tongue for withdrawal.

At the time of complete make-up of the joint, the tongue has been drawn into the recess by the fastener to exactly fit and partially compress the cured filler material, at all four tongue lengthwise tapers, at which time the latch then drops into its retention recess, and the stop-shoulders come into interengagement, about the tongue; thus even though fastener 24 should inadvertently loosen, the latch is held in compression by the compressed filler acting on the tongue, resisting decompression of the filler material at all sides of the tongue whereby the tight interfit is maintained (it being impossible to inadvertently release the latch). Skier safety is therefore at all times optimized in a way and by means previously never contemplated, disclosed or suggested by the prior art, the deficiencies of which are very clear to those skilled in the art.

FIG. 27 shows the provision of interfitting corrugation at 701 and 702 on the filler material 501 and recess wall 12*a.* Similar corrugations may be formed on filler 502 and wall 12*b,* and such corrugations extend along the tapers as seen in FIG. 23, i.e. in the taper direction. They assist in retaining the bonds formed between the cured filler and the metallic walls, at the corrugation locations.

I claim:

1. A ski characterized by, (a) at least two ski sections interconnectible end to end, (b) one ski section having a recess sunk in an end portion thereof and the other ski section having a tongue projecting from an end portion thereof, the recess and tongue having conforming complementary wedge shapes to closely interfit when the ski sections are assembled, end to end, thereby to provide a full length ski, the tongue received into the recess, and the tongue having four end tapers in generally horizontal and vertical planes to be completely surrounded by complementary tapers of said recess, (c) and threaded fastener means to positively and releasably interconnect said end portions in assembled condition, said fastener means everywhere confined within space between planes defined by outer top, bottom and opposite side major flat surfaces of one or both of said sections in interfitted condition, and the fastener means passing through planes defined by at least two complementary recess and tongue tapered wedge surfaces, (d) there being four interengaged pairs of stop shoulders on the ski sections to resist up and down and lateral bending, the shoulders located proximate the root ends of the four tapers on the tongue, all of said stop shoulders also everywhere confined within space between said planes defined by said section major flat outer surfaces, said stop shoulders intersecting said surfaces, (e) said recess and tongue complementary wedge shapes including (i) polished surfaces defined by the tongue, (ii) plastic filler surfaces defined by the recess, (iii) the plastic filler surfaces having been deformed by the polished surfaces of the tongue preliminarily received fully into the recess, and the plastic filler surfaces then having been allowed to cure, so as to be in cured state when the tongue is received to closely interfit the recess as defined in (b), (iv) the cured plastic filler being held in predetermined compression by the ski sections including said tongue when the pairs of stop shoulders are interengaged.

2. The ski of claim 1 wherein said sections have metal-to-metal interfit at said interengaged pairs of stop shoulders to positively limit pressural engagement of said polished surfaces of the tongue with said filler surfaces.

3. The ski of claim 1 including vent means on at least one section to pass air trapped in said recess upon reception of the tongue therein prior to curing of the plastic filler.

4. The ski of claim 1 wherein each section has a metallic portion and a non-metallic portion, said metallic portion defining said tongue and recess, said non-metallic portion interlocked to said metallic portion at locations spaced lengthwise of the ski from said tongue and recess.

5. The ski of claim 4 wherein said metallic portion and non-metallic portions of each ski section have tongue and groove interfit at an interlock location.

6. The ski of claim 5 including adhesive bonding the metallic and non-metallic portions at said tongue and groove interfit therebetween.

7. The ski of claim 4 including a spring-urged latch interconnecting said metallic portion, and at the tongue and recess interfit location, and within the confines of the ski section outer surfaces.

8. The ski of claim 7 wherein said latch includes a latching element carried by one of the metallic portions and initially projecting into the recess to be deflected in response to tongue reception into the recess, and means associated with one or the other of the sections to release the latching element when the tongue is to be removed from the recess.

9. The ski of claim 1 wherein said (c) means includes a binding plate overlapping said two sections and connected thereto.

10. The ski of claim 1 wherein the tongue and recess have wedge interfit laterally of the ski.

11. The ski of claim 8 wherein said threaded fastener means is spaced lengthwise of the ski from said latch, the fastener means and latch everywhere confined within boundaries defined by outer surfaces of the metallic portions.

12. The ski of claim 1 wherein certain of the stop shoulders extend laterally of the ski.

13. The ski of claim 8 wherein said metallic portion and non-metallic portion of each ski section have tongue and groove interfit at an interlock location.

14. The ski of claim 13 including adhesive bonding the metallic and non-metallic portions at said tongue and groove interfit therebetween.

15. The ski of claim 1 wherein at least one section includes a metallic portion said portions being interconnected.

16. In the method of forming a ski characterized by (a) at least two ski sections interconnectible end to end, (b) one ski section having a recess sunk in an end portion thereof and the other ski section having a tongue projecting from an end portion thereof, the recess and tongue having conforming complementary wedge shapes to closely interfit when the ski sections are assembled, end to end, thereby to provide a full length ski, the tongue received into the recess, and the tongue having four end tapers in generally horizontal and vertical planes to be completely surrounded by complementary tapers of said recess, (c) and threaded fastener means to positively and releasably interconnect said end portions in assembled condition, said fastener means everywhere confined within space between planes defined by outer top, bottom and opposite side major flat surfaces of one or both of said sections in interfitted condition, and the fastener means passing through planes defined by at least two complementary recess and tongue tapered wedge surfaces, (d) there being four interengaged pairs of stop shoulders on the ski sections to resist up and down and lateral bending, the shoulders located proximate the root ends of the four tapers on the tongue, all of said stop shoulders also everywhere confined within space between said planes defined by said section major flat outer surfaces, said stop shoulders intersecting said surfaces, said method including the steps:

(e) providing said tongue with polished surfaces, (f) providing the recess with initially uncured plastic filler surfaces, (g) initially inserting the tongue into the recess to engage the plastic filler surfaces to cause the tongue to deform the plastic surfaces to final shape exactly conforming to fully inserted tongue surface shape, (h) removing the tongue from the recess and allowing said plastic surfaces to cure, (i) and subsequently re-inserting the tongue into the recess to engage the cured plastic surfaces, and tightening said fastener means, thereby to hold the cured plastic filler in compression.

17. The method of claim 16 including employing a film of release agent between the tongue and said uncured, plastic filler during said (g) step; and also allowing the plastic filler to bond to the ski section defining the recess, as it cures.

18. The method of claim 16 including venting trapped air from the recess during said (g) step.

19. The method of claim 16 wherein each ski section has a metallic portion, said portions defining said tongue and recess, and bringing said metallic portions into metal-to-metal interfit at said interengaged pairs of stop shoulders to positively limit the engagement of the polished surfaces of the tongue with said filler surfaces, during said (g) step, and also during said (i) step.

20. The method of claim 19 wherein each ski section also has a non-metallic portion, and including interlocking said metallic and non-metallic portions of each ski section at locations spaced endwise from said tongue and recess.

21. The method of claim 20 wherein said interlocking is carried out by adhesively bonding said portions internally of said portions.

22. The method of claim 16 including providing a spring-urged latch interconnecting said metallic portions and at the tongue and recess interfit locations, and within the confines of the ski section outer surfaces.

23. The method of claim 16 wherein said tightening of the fastener means is carried out to cause the tongue to compress said cured filler to predetermined extent prior to latching of said sections by said latch.

24. The method of claim 16 wherein said filler consists of urethane synthetic resin.

25. The combination of claim 1 wherein the end portion that defines the recess has a corrugated inner wall bonded to a layer of filler material that defines a filler surface engaged by the tongue.

* * * * *